US008471480B2

(12) United States Patent
Kinderman et al.

(10) Patent No.: US 8,471,480 B2
(45) Date of Patent: Jun. 25, 2013

(54) DECORATIVE LIGHT STRING HAVING MASTER AND SLAVE MODES AND MASTER OVERRIDE SWITCH

(76) Inventors: Israel Richard Kinderman, Philadelphia, PA (US); David Wong, Hung Hom (HK)

( * ) Notice: Subject to any disclaimer, the term of this patent is extended or adjusted under 35 U.S.C. 154(b) by 353 days.

(21) Appl. No.: 12/782,942

(22) Filed: May 19, 2010

(65) Prior Publication Data

US 2011/0285299 A1 Nov. 24, 2011

(51) Int. Cl.
*H05B 39/00* (2006.01)
*H05B 41/00* (2006.01)
*H05B 37/00* (2006.01)

(52) U.S. Cl.
USPC ..... 315/185 R; 315/185 S; 315/192; 315/312; 315/316

(58) Field of Classification Search
USPC ..... 315/192
See application file for complete search history.

(56) References Cited

U.S. PATENT DOCUMENTS

| | | | | |
|---|---|---|---|---|
| 7,175,302 | B2 * | 2/2007 | Kazar et al. | 362/231 |
| 7,508,141 | B2 * | 3/2009 | Wong | 315/185 S |
| 7,758,234 | B1 * | 7/2010 | Savicki et al. | 362/641 |
| 8,013,535 | B2 * | 9/2011 | Jozwik | 315/200 A |
| 2010/0327780 | A1 * | 12/2010 | Hoschopf | 315/312 |

* cited by examiner

*Primary Examiner* — Douglas W Owens
*Assistant Examiner* — Dedei K Hammond
(74) *Attorney, Agent, or Firm* — Novak Druce Connolly Bove + Quigg LLP

(57) ABSTRACT

A decorative light string includes a controller having a master mode and a slave mode, with the master mode being the default. A light strand including a plurality of light emitting elements is operatively coupled to the controller, as is a light pattern selector. In the master mode, the controller is configured to control the light emitting elements according to a setting input at the light pattern selector. A mode select circuit is electronically coupled to the controller, and the controller is configured to enter the slave mode when a control signal is received by the mode select circuit.

30 Claims, 11 Drawing Sheets

DECORATIVE LIGHT STRING HAVING MASTER AND SLAVE MODES AND MASTER OVERRIDE SWITCH

BACKGROUND OF THE INVENTION

1. Field of the Invention

The field of the present invention is decorative light strings.

2. Background

Decorative light strings are commonly used to produce visual effects at homes and in business locations around the holiday seasons. A light string that is bright and rich in flashing patterns will often strongly improve the holiday spirit of all who see it. Since light strings are limited in length, they are commonly connected together in series end-to-end when more decorating length is needed. Combining more strings together not only makes decorating easier, but it also makes decorating less expensive and time consuming since fewer electrical outlets and/or extension cords are required. When flashing or other patterns are desired, the light strings with controllers are required. However, when multiple light strings, with controllers, are connected in series, there will be a synchronization problem between the light strings, even when the same flashing pattern is used for each light string. The controllers simply have no feature which permits close synchronization between the light strings. Even powering the light strings simultaneously does not guarantee synchronization.

This synchronization problem is exacerbated when the flashing pattern is changed, because the user must go to the controller of each separate light string to change the settings individually, one at a time. Of course, when many different light strings are chained together in series, changing the settings of every single controller presents its own set of difficulties.

Other light strings attempt to get around the synchronization problem by using timed sequence patterns, thereby giving the appearance of synchronization. These timed sequence patterns are set to start at the beginning of each string when the string is first powered, so that connected strings have the appearance of synchronization. However, with such strings, the light pattern cannot be changed by the user, as the controller includes only the one pre-set pattern to always maintain the appearance of synchronization.

Other types of light strings allow the end user to change the pattern either with a remote control, or even have the lights flash to the beat of music. However, even with these types of light strings, when several are connected in series, the flashing patterns of the light strings are not actively synchronized, other than by happenstance, due to slight differences in the reference clock frequency at the controller of each light string. With more light strings used in a single space, regardless of whether they are connected together in series, the differences in reference clock frequencies will be exacerbated.

SUMMARY OF THE INVENTION

The present invention is directed toward a decorative light string. The light string includes a controller which has a master mode and a slave mode and is configured to default into the master mode. A light strand, a light pattern selector, and a mode select circuit are operatively connected to the controller. The light strand includes a plurality of light emitting elements, and when the controller is in the master mode, it is configured to control the light emitting elements according to a setting input at the light pattern selector. The controller is also configured to enter the slave mode when the mode select circuit receives a control signal.

Several different options may be incorporated in the light string, either alone or in combination. As one option, in the slave mode, the controller is configured to control the light emitting elements according to the control signal received by the mode select circuit. As another option, the light string includes an override switch, and the controller is configured to remain in the master mode when the override switch is actuated to a predetermined position. In yet another option, the mode select switch includes a light sensing element which is configured to be coupled to a light emitting element of another decorative light string. With this option, the controller may be configured to control the light emitting elements based on a signal received by the light sensing element from the other light string. With such a light sensing element present, a housing for the controller may include a storage compartment configured to substantially isolate the light sensing element from light. As yet another option, the light emitting elements may be LEDs, or any other type of electrical light source.

Accordingly, an improved decorative light string is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
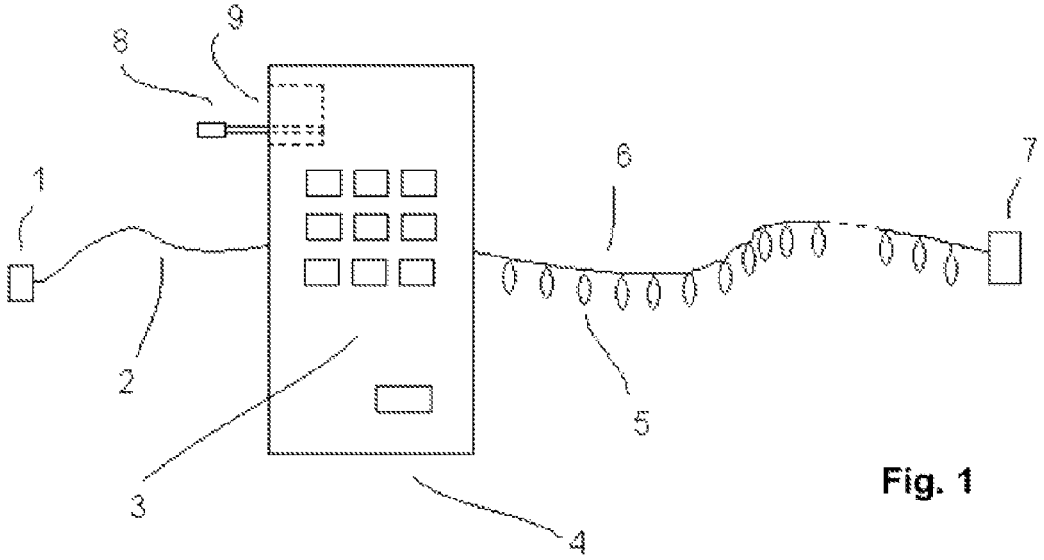
FIG. 1 illustrates a decorative light string incorporating a control sensor.

Turning in detail to the drawings, FIG. 1 illustrates a decorative light string. The string receives power through a first standard electrical plug 1 affixed at the end of an electrical lead 2 extending from a control box 4. The control box 4 includes a selector keypad 3 (which may alternatively be a series of selector switches) by which a lighting scheme or flashing pattern may be selected to display with the light strand 6. The light strand 6 includes a plurality of light-emitting elements 5 distributed along its length, at the end of which is a second standard electrical plug 7. The first and second plugs 1, 7 form a male-female pair to enable multiple decorative light strings to be connected in series. The light-emitting elements 5 may be of any appropriate type, including single LEDs, multi-LEDs, LED clusters, incandescent lamps, and the like. In the description below, even where a specific type of lighting element is referenced, those of skill in the art will recognize that other types of lighting elements may be substituted, in some cases directly, and in other cases with appropriate changes to the circuitry. A lead 8 for a mode select circuit extends from the control box 4, and the control box 4 includes a compartment 9 for storage of this lead 8 when not in use. As described below, when the lead 8 includes a light sensing element, the compartment includes a cover which is capable of sealing the lead within and substantially isolating the lead 8 from all light sources.

Figure 2:
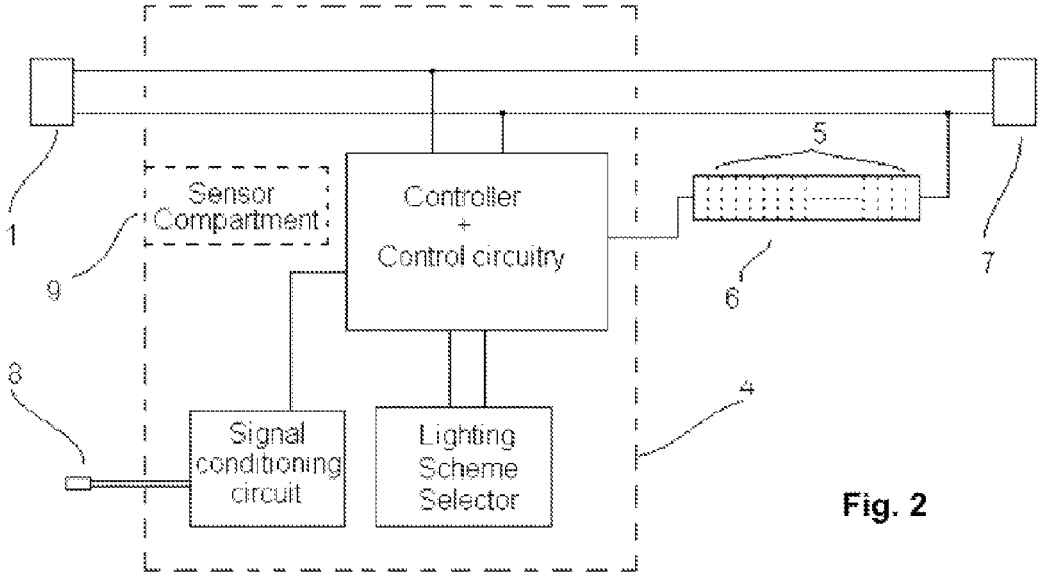
FIG. 2 schematically illustrates the decorative light string of FIG. 1.

As is shown in FIG. 2, the control box 4 houses a control circuit, a mode select circuit, and a lighting scheme selector, any of which may be combined into a single circuit as a matter of design choice. The control circuit is configured to operate in either a master mode or a slave mode. In the master mode, the control circuit controls the scheme and/or flashing pattern of the lighting elements according to input from the lighting scheme selector. In the slave mode, the control circuit controls the scheme and/or flashing pattern of the lighting elements according to a control signal from the mode select circuit, the control signal being received from another light string.

The lighting scheme selector includes a user accessible portion, such as a keypad, selector switches, a remote control, and the like, to enable a user to select one of various preprogrammed lighting schemes or flashing patterns. The lighting scheme selector may also include a master/slave override switch, by which the control circuit may be locked into the master mode when this switch is activated or placed in the designated position. Where the lighting elements are incandescent lamps or single color LEDs, the choices will be typically limited to flashing patterns, including no flashing at all. Where the lighting elements are multi-color LEDs or LED clusters, the choices will be typically limited only by the preprogrammed schemes and patterns, which are in turn limited primarily by the number of schemes and patterns that can be preprogrammed into the controller. Thus, the versatility, in terms of the number of schemes and patterns, of light strings using mutli-color LEDs or LED clusters are a matter of design choice.

The mode select circuit includes the lead for connecting one light string to another, and this lead is configured to receive the control signal from a second light string. In instances where the mode select circuit includes a mode sensor, such as a light sensor which is optically coupled to a light emitting element of another light string, the mode select circuit may also include a signal conditioning circuit to better enable the mode select circuit to identify the scheme or flashing pattern displayed by the other light string in the presence of background light or other noise impinging upon the mode sensor. In other instances, depending upon design choice, the mode select circuit may receive the control signal by direct electronic coupling with the other light string.

Figure 3:
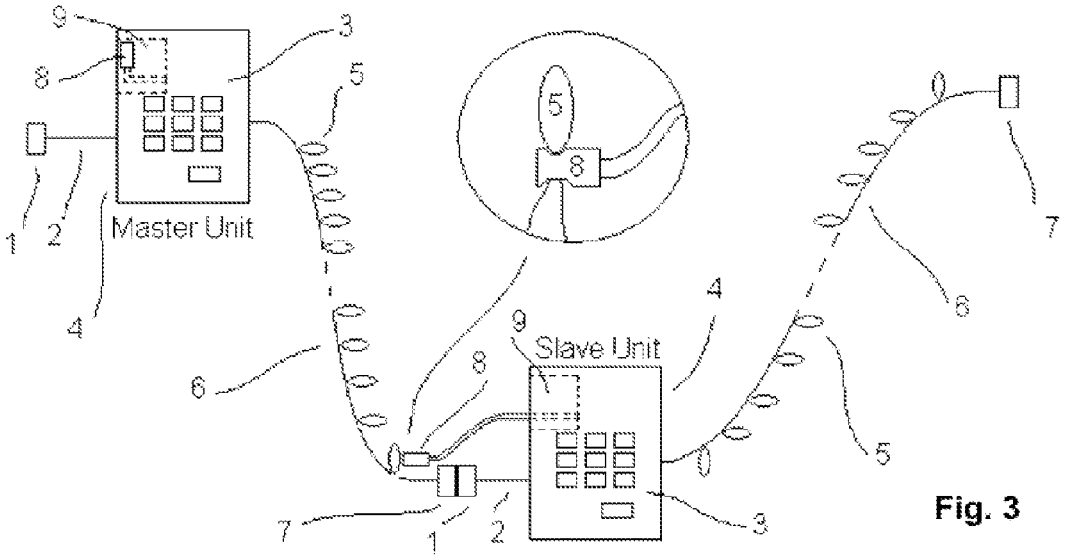
FIG. 3 illustrates two interconnected decorative light strings.
Figure 4:
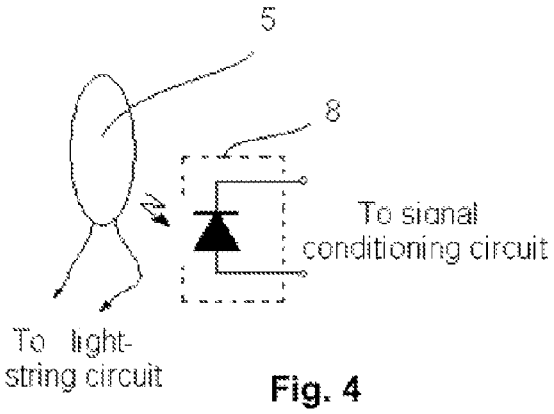
FIG. 4 illustrates a first embodiment of a control sensor.

Two light strings connected in series are shown in FIG. 3, with the second light string drawing power through the first light string. Here, the controller of the first light string is operating in the master mode because the lead for the mode select circuit is stowed in the housing compartment and is not receiving any signal. The controller of the second light string is operating in the slave mode because the lead for its mode select circuit, which as shown is a light sensor, is receiving a control signal by being optically coupled to the last lighting element of the first light string. FIG. 4 illustrates a light sensor of one light string placed adjacent to a lamp of another light string. With this configuration, the light sensor generates a control signal based upon the on/off sequence of or the color displayed by the lamp, and this signal is passed through a conditioning circuit to better isolate the control signal from background noise. Once the control signal has been properly conditioned, the receiving controller will operate the light strand by selecting a scheme or pattern based on the control signal, as the various schemes and patterns that may be displayed by the master light string will each generate a unique control signal in the slave light string. By identifying the scheme or pattern of the master light string in this manner, the slave light string may not only select the same pattern, but closely match the timing of any flashing pattern displayed by the master light string, thereby synchronizing the two (or more) light strings in a manner not previously possible with the light strings of the prior art.

Figure 5:
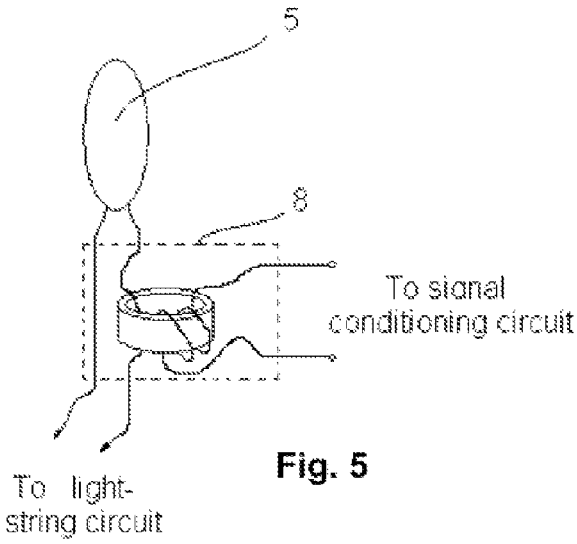
FIG. 5 illustrates a second embodiment of a control sensor.

A second type of lead for the mode selector circuit is illustrated in FIG. 5. This lead includes a conducive ring and a wire wrapped at least several times around a portion of the ring to form an inductor. The lighting element is coupled to this lead by passing one of its electricity-conducting legs through the center of the ring, thereby enabling the inductor to generate a control signal in response to the current being provided to the lighting element. This control signal may be appropriately conditioned and provided to the controller of the slave light string in the manner described above to select a matching scheme or pattern.

As an alternative, regardless of the type of type of lead included with the mode selector circuit, the controller of the master light string may be configured to add a sub-signal to the scheme or pattern on display. This sub-signal may be modulated in a frequency range that is not readily visible to the human eye, e.g., in excess of 75 Hz, and it may be generated directly by the controller, or it may be generated by a separate circuit incorporated as part of the last light emitting element in the light strand.

Figure 6:
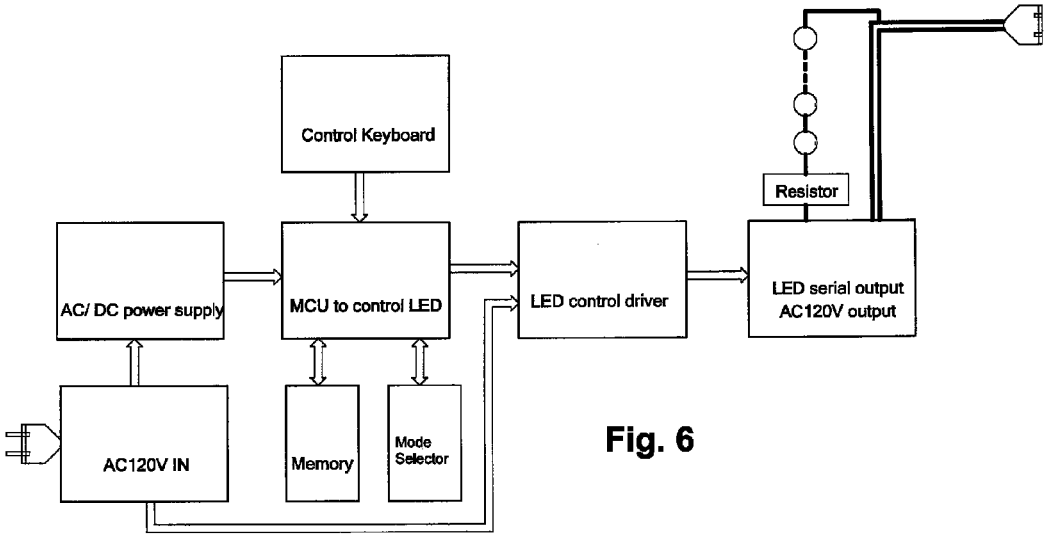
FIG. 6 schematically illustrates control circuitry for a decorative light string.

The combined circuits for a single-lead light string are schematically depicted in FIG. 6. Those skilled in the art will recognize that this single-lead configuration may be easily converted into a double-lead configuration by selection of the appropriate controller and by providing the appropriate outputs for each lead. For example, a double-lead configuration may operate in the same manner as a single-lead configuration, except the double-lead configuration includes two control lines, and each control line operates a separate set of light emitting elements on the light strand, preferably LEDs due to power consumption requirements and color selection capabilities. Additionally, a multi-lead configuration may utilize the additional lead(s) for other purposes. In a light string having a multi-lead configuration, the light emitting elements may each include their own sub-circuit, such that one or more leads may be used to provide power to the light emitting elements and the associated sub-circuits, and one or more additional leads may be used to communicate a control signal to the sub-circuits, thereby providing greater control over the schemes and patterns that may be displayed. These different options are discussed in greater detail below, however, the configuration of the light string, whether it includes a single lead or multiple leads, is a matter of design choice.

The single-lead circuit of FIG. 6 includes an AC power input, which divides the AC power and directs it to both an AC to DC converter and to the LED driver. The AC power is passed through the LED driver to the LED output, and on to the electrical plug at the end of the light strand. DC power from the converter is directed into the microcontroller, which receives input from the control keypad and accesses the memory.

A user may use the control keypad to control the scheme and/or flashing pattern that the microcontroller retrieves from storage within the memory. Preferably, the control keypad includes a dedicated pattern selector switch (not shown) by which the user can control the flashing pattern displayed by the lights. Based upon the retrieved scheme and/or flashing pattern the microcontroller provides an appropriate signal to the LED control driver, which in turn outputs an appropriate signal to effectuate the scheme and/or pattern in the light strand. The memory may also be used to store the last scheme and/or flashing pattern displayed before the light string is powered down so that the controller may restore that same scheme and/or flashing pattern upon the next power up. The type and character of signals generated and communicated between the various components within the circuit are a matter of design choices made for each component, and as such are not discussed in detail herein.

The control keypad includes at least one override switch which, when actuated into a predetermined position, serves to keep the microcontroller locked into the master mode. Otherwise, the microcontroller is configured to enter into the slave mode when it receives a signal from the mode selector, which receives input (not shown) from another light string when the lead is connected as discussed above. In the slave mode, the microcontroller receives a control signal from the mode selector, and uses that control signal to identify a scheme and/or flashing pattern within memory on which to base control of the light strand. The control signal is also used to affect the timing of the scheme and/or flashing pattern, whether the timing is maintained by the microcontroller or by the LED control driver.

Figure 7:
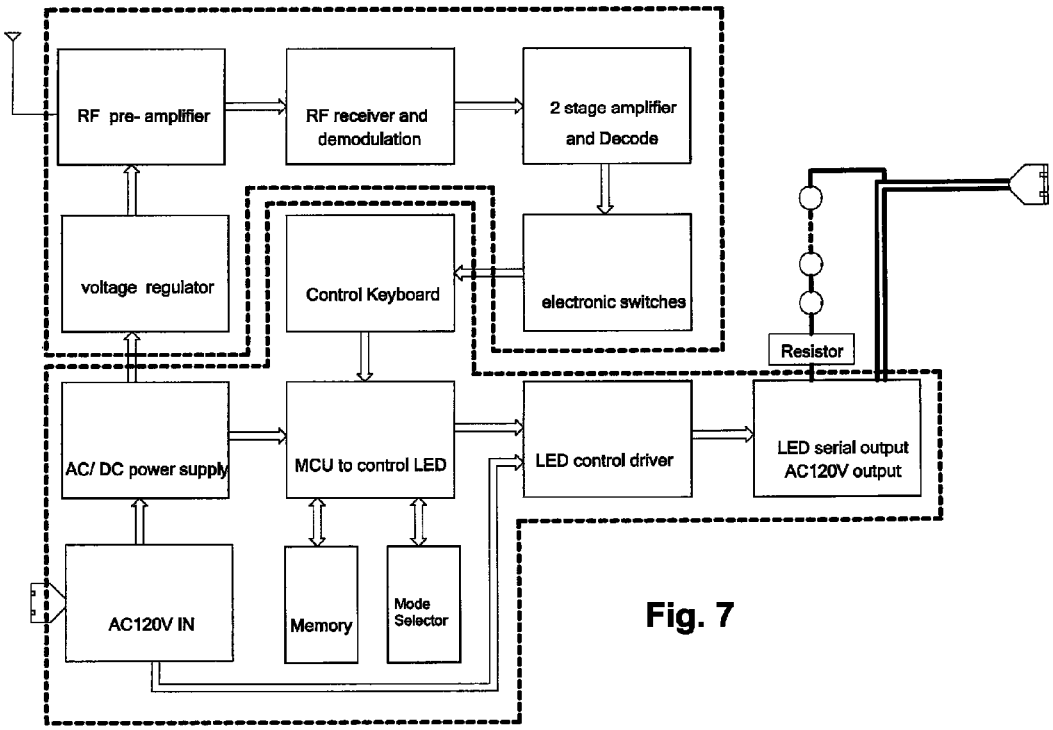
FIG. 7 schematically illustrates control circuitry incorporating a remote control receiver.

FIG. 7 illustrates the circuits incorporating a remote control receiver. DC power is provided to a voltage regulator, which in turn drives pre-amplifier connected to an antenna. Signal from the preamplifier is processed through a demodulator, then through a two stage amplifier and decoder, and finally the signal is interpreted in a series of electronic control switches which interface with the control keypad, so that direct input into the control keypad may be simulated by the electronic control switches. Depending upon the number of schemes and/or flashing patterns stored in the memory, a series of 4 electronic control switches may be sufficient. However, more or fewer electronic control switches may be incorporated according to design choice.

Figure 8:
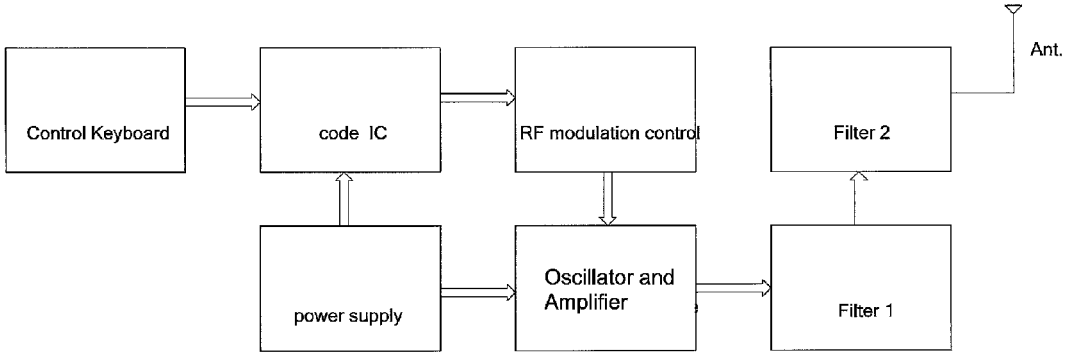
FIG. 8 schematically illustrates a remote control.

The remote control shown in FIG. 8 includes a power supply, preferably batteries, providing power to the various components. The remote control includes a control keypad similar to the keypad found on the control box, and input selections made at the control keypad are encoded by an encoding circuit, which sends a signal to the modulation control circuit, and then on to the oscillator and amplifier. Signal from the oscillator and amplifier is passed through two filters, then transmitted via the antenna. Such remote controls and the receipt and processing of the remote control signals at the controller are well understood by those of skill in the relevant arts.

Figure 9A:
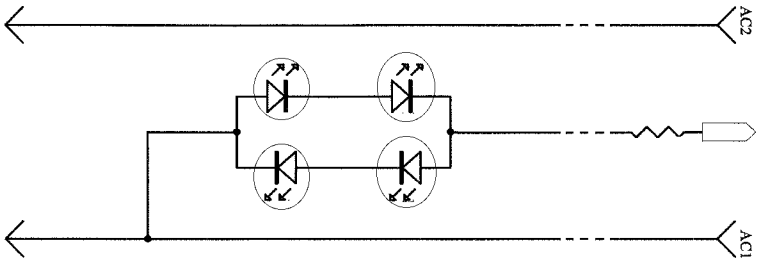
FIGS. 9A & 9B schematically illustrate light strands having a single control line for a series of light elements.
Figure 9B:
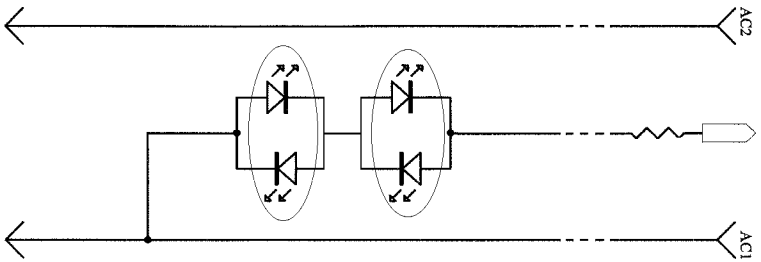

Two basic configurations for a light strand are illustrated in FIG. 9A and FIG. 9B. Each of these configurations use multiple LEDs configured to take advantage of a bidirectional current. In FIG. 9A, two sets of LEDs are coupled into the circuit, with the first set of LEDs being arranged to illuminate when the current flows in one direction, and the second set of LEDs being arranged to illuminate when the current flows in the opposite direction. The direction of the current is controlled in a known manner by a thyristor (not shown). This configuration permits the light string to display the two sets of LEDs in a flashing display, or one of the two sets may be displayed with or without flashing.

FIG. 9B shows a variation of this configuration, where multi-color LEDs are used as the lighting elements. In this configuration, each multi-color LED is coupled into the circuit so that the bidirectional current illuminates one of the colors in the multi-color LED when flowing in one direction, and the other color when flowing in the opposite direction. With an entire light strand formed using this configuration, two different color configurations are enabled, and either or both configurations may incorporate a flashing pattern. By way of example, a light strand may be configured to illuminate a color pattern using multi-color LEDs selected to illuminate a single, solid color with current flowing in one direction, and a multi-color pattern with current flowing in the opposite direction. Such a light string would be useful to the consumer for at least two different holiday displays. The number of colors in and the arrangement of colors along the light strand used to create the multi-color pattern is a matter of design choice.

For a simpler light string, with only basic flashing ability and no color-changing ability, a single strand of incandescent lamps or LEDs in series may be implemented without a thyristor. In this latter configuration, the lamps or LEDs may be of a single, solid color, or the different lamps or LEDs may be of various colors and in any pattern, as a matter of design choice.

Figure 10:
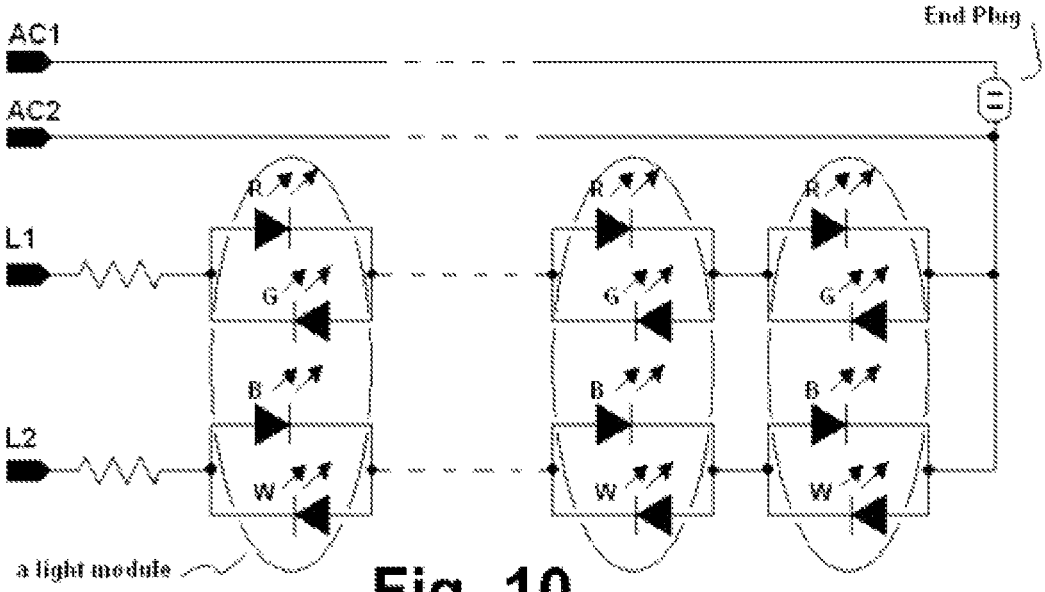
FIG. 10 schematically illustrates a light strand having two control lines for a series of light modules.
Figure 11:
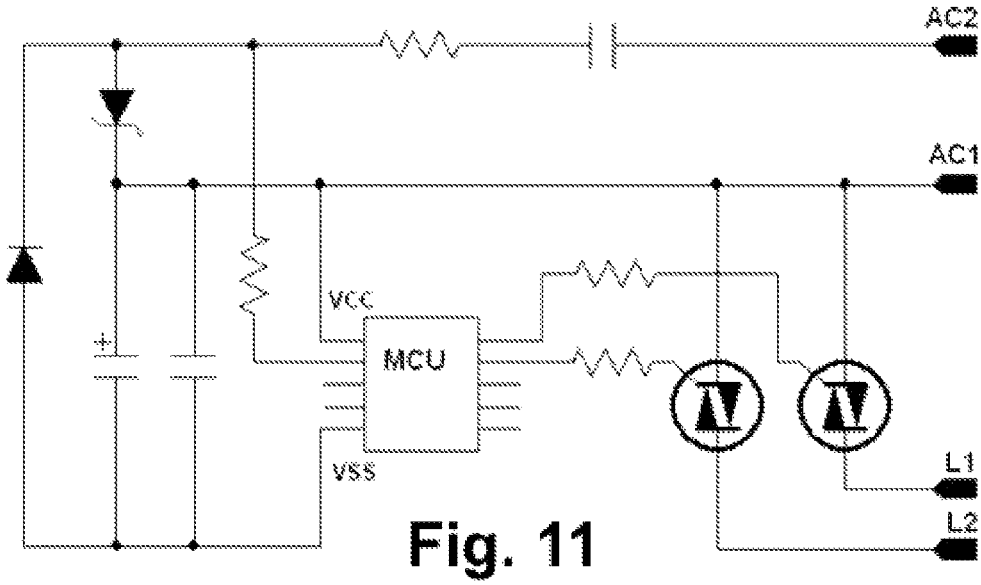
FIG. 11 schematically illustrates a light module.

A more complex arrangement of the light strand, using multi-color LEDs, is shown in FIG. 10. This arrangement is a double-lead configuration, with each lead connecting to a series of light modules, with each light module including at least a pair of multi-color LEDs. As shown, each module includes two multi-color LEDs, to provide the ability to display one or two colors simultaneously by driving each lead line from the microcontroller with an independent SCR as shown in FIG. 11. Further, the module places the LEDs in close proximity so that, viewed from a distance, when two of the LEDs are simultaneously activated, the two LED sources are indistinguishable from one another, making the light from the two LEDs appear blended in both source and color. Implemented in this manner, the light modules permit greater versatility in the color variation schemes that may be displayed with the light string, as any one color LED may be activated, and a variety of LED color pairs may be simultaneously activated. The module of FIG. 10, having two multi-color LEDs, enables a total of eight distinct colors to be displayed. When combined with different flashing patterns, the multiple colors available with just two multi-color LEDs on a module provide a wider variety of schemes and patterns than has previously been available with any light string of the prior art. More colors may be enabled by adding lead lines and including additional multi-color LEDs on each light module. Alternatively, additional color variations may be obtained by adjusting the brightness of one color LED relative to another LED that is simultaneously activated.

Figure 12:
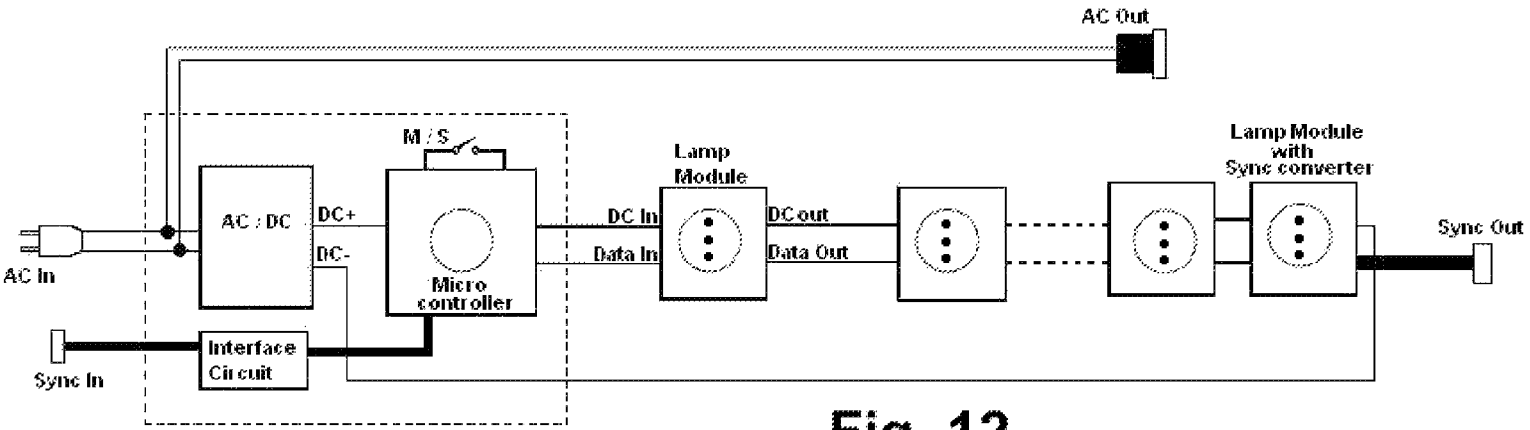
FIG. 12 schematically illustrates an alternative decorative light string.

A more complex double-lead light string is illustrated in FIG. 12. In this configuration, the light strand includes light emitting elements that are implemented as light modules connected in series by two leads. As shown, each light module includes three LEDs, which may be single color or multi-color LEDs, although any number of LEDs may be included on the light modules. One of the leads supplies a DC voltage to the modules, and the other provides a data signal to the modules. The data signal also includes a timing signal, thus eliminating the need to implement separate timing signals on each of the light modules. Each module includes its own integrated circuit to interpret the data signal and timing signals and to activate the LEDs on the module according to each signal. Optionally, the integrated circuit of each module may include it's own memory for electronic storage of color schemes and flashing patterns. As another option, the integrated circuit of each module may be associated with a unique identifier, thereby enabling the controller to control each module on the light strand independently from the other modules.

The light string of FIG. 12 enables activation of each LED on each module simultaneously and with differing intensities as compared to the other LEDs on the same module. In a configuration where the LEDs on each module are placed in close physical proximity, when viewed from a distance with the LEDs of a module simultaneously activated, light from the LEDs on that module blend in both source and color. Further, in instances where each module is independently controlled, the color and intensity displayed by any one module is independent of the color and intensity displayed by any other module. These features, when implemented in combination, give the light string of FIG. 12 the ability to display practically an infinite number of color schemes and/or flashing patterns, exceeding the capability of what has previously been available with any light string of the prior art.

Thus, a decorative light string is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A decorative light string comprising:

a controller having a master mode and a slave mode and being configured to default into the master mode;

a light strand operatively coupled to the controller and including a plurality of light emitting elements;

a light pattern selector operatively coupled to the controller, wherein the controller in the master mode is configured to control the light emitting elements according to a setting input at the light pattern selector;

a mode select circuit coupled to the controller, wherein the controller is configured to enter the slave mode when a control signal is received by the mode select circuit, the control signal being received from another light string; and an override switch, wherein the controller is configured to remain in the master mode when the override switch is actuated to a predetermined position.

2. The decorative light string of claim 1, wherein in the slave mode, the controller is configured to control the light emitting elements according to the control signal received by the mode select circuit.

3. The decorative light string of claim 1, wherein the mode select circuit is configured to be coupled to and to receive the control signal from another decorative light string.

4. The decorative light string of claim 1, wherein the mode select circuit comprises a sensing element configured to be coupled to a light emitting element in another decorative light string.

5. The decorative light string of claim 4, wherein in the slave mode, the controller is configured to control the light emitting elements based on a signal received by the sensing element from the other decorative light string.

6. The decorative light string of claim 4, further comprising a housing, wherein sensing element comprises a light sensing element and the housing includes a storage compartment configured to substantially isolate the light sensing element from light.

7. The decorative light string of claim 1, wherein the light emitting elements comprise LEDs.

8. The decorative light string of claim 7, wherein each LED is coupled in parallel and in reverse orientation with at least one other LED.

9. The decorative light string of claim 7, wherein each LED comprises a multi-color LED.

10. The decorative light string of claim 9, wherein the multi-color LEDs emit at least one uniform color.

11. The decorative light string of claim 1, wherein the controller is configured to control the light emitting elements using a predetermined pattern and an associated predetermined sub-pattern.

12. The decorative light string of claim 11, wherein the sub-pattern represents a downstream control signal.

13. The decorative light string of claim 1, wherein the light pattern selector comprises a keypad disposed in a housing containing the controller.

14. The decorative light string of claim 1, wherein the light pattern selector comprises a wireless remote control.

15. A system of decorative light strings, the system comprising:

first and second light strings, each comprising:

a controller having a master mode and a slave mode and being configured to default into the master mode;

a light strand operatively coupled to the controller, the light strand including a plurality of light emitting elements;

a light pattern selector operatively coupled to the controller, wherein the controller in the master mode is configured to control the light emitting elements according to a setting input at the light pattern selector;

a mode select circuit electronically coupled to the controller, wherein the controller is configured to enter the slave mode when a control signal is received by the mode select circuit, and the controller in the slave mode is configured to control the light emitting elements according to the received control signal; and an override switch, the controller being configured to remain in the master mode when the override switch is actuated to a predetermined position, wherein the mode select circuit of the second light string is operatively coupled to the first light string, the mode select circuit of the second light string being configured to receive the control signal from the first light string.

16. The system of claim 15, wherein the mode select circuit comprises a sensing element, and the sensing element of the second light string is coupled to a light emitting element in the first light string.

17. The system of claim 16, wherein in the slave mode, the controller of the second light string is configured to operate the second light string based on a signal received by the sensing element from the first light string.

18. The system of claim 16, wherein each light string further comprises a housing, with the controller being disposed in the housing, and the sensing element of each light string comprises a light sensing element, wherein the housing includes a storage compartment configured to substantially isolate the light sensing element from light.

19. The system of claim 15, wherein the light emitting elements comprise LEDs.

20. The system of claim 19, wherein each LED is coupled in parallel and in reverse orientation with at least one other LED.

21. The system of claim 19, wherein each LED comprises a mufti-color LED.

22. The system of claim 21, wherein the mufti-color LEDs emit at least one uniform color.

23. The system of claim 15, wherein the controller is configured to control the light emitting elements using a predetermined pattern and an associated predetermined sub-pattern, the sub-pattern representing the control signal.

24. The system of claim 15, wherein the light pattern selector comprises a keypad disposed in a housing containing the controller.

25. The system of claim 15, wherein the light pattern selector comprises a wireless remote control.

26. A decorative light string comprising:

a controller including a DC voltage output, a data input, and a data output, the controller having a master mode and a slave mode and being configured to default into the master mode;

an override switch, wherein the controller is configured to remain in the master mode when the override switch is actuated to a predetermined position;

a light pattern selector operatively coupled to the controller, wherein the controller is configured to generate the data output according to a setting input at the light pattern selector; and a plurality of light modules coupled in series to the controller, each module including a module circuit, which receives the DC voltage output and the data output, and a plurality of light emitting elements, wherein the light emitting elements on each light module are placed in close physical proximity, and the module circuit is configured to control flashing and intensity of each light emitting element of the respective light module according to the data output.

27. The decorative light string of claim 26, wherein the controller in the master mode is configured to generate the data output according to the setting input at the light pattern selector.

28. The decorative light string of claim 26, wherein the controller is configured to enter the slave mode when a control signal is received at the data input, and the controller in the slave mode is configured to generate the data output according to the received control signal.

29. The system of claim 26, wherein the light pattern selector comprises a keypad disposed in a housing containing the controller.

30. The system of claim 26, wherein the light pattern selector comprises a wireless remote control.

* * * * *